United States Patent [19]

McClain, III

[11] Patent Number: 5,036,747

[45] Date of Patent: Aug. 6, 1991

[54] MUZZLE BRAKE

[76] Inventor: Harry T. McClain, III, P.O. Box 5, Riviera, AZ 86442

[21] Appl. No.: 565,187

[22] Filed: Aug. 8, 1990

Related U.S. Application Data

[63] Continuation of Ser. No. 84,374, Aug. 11, 1987, abandoned, which is a continuation-in-part of Ser. No. 798,866, Nov. 18, 1985, abandoned.

[51] Int. Cl.[5] ..... F41A 21/36

[52] U.S. Cl. ..... 89/14.3

[58] Field of Search ..... 42/79; 89/14.2, 14.3

[56] References Cited

U.S. PATENT DOCUMENTS

| | | | |
|---|---|---|---|
| 858,745 | 7/1907 | McClean | 89/14.3 |
| 1,363,058 | 12/1920 | Schneider | 89/14.3 |
| 2,206,568 | 7/1940 | Hughes | 89/14.3 |
| 2,453,121 | 11/1948 | Cutts | 89/14.3 |
| 2,861,375 | 11/1958 | Rodick | 42/79 |
| 4,203,347 | 5/1980 | Pinson et al. | 89/14.2 |
| 4,545,285 | 10/1985 | McLain | 89/14.3 |

FOREIGN PATENT DOCUMENTS

| | | | |
|---|---|---|---|
| 800052 | 6/1936 | France | 89/14.3 |
| 4690 | of 1896 | United Kingdom | 89/14.3 |
| 479107 | of 1938 | United Kingdom | 89/14.3 |

*Primary Examiner*—Stephen C. Bentley
*Attorney, Agent, or Firm*—Robert E. Harris

[57] ABSTRACT

A muzzle recoil brake which enables propellant gases to escape through a sequence of expansion stages along the length of the brake. Each expansion stage includes circumferentially disposed passageways or apertures which permit gases to exit the brake. The expansion stage also includes gas expansion chambers. Interior plates transversely positioned and axially spaced define interior expansion chambers while caps comprising radially extending plates and circumferential skirts define exterior expansion chambers. The gases from the brake impinge the interior surfaces of the expansion chambers to reduce recoil. Gases are conserved in the brake and a metered portion of the gas is vented at each stage in the sequence of stages. The size or position of the vent aperture or expansion chamber with respect to adjacent apertures or chambers, or a combination thereof, permits retention and conservation of the propellant gases. Thus, it is generally necessary that the stages increase in volume towards the muzzle end or that the passageways from the brake increase in size towards the muzzle and, or that both the stages and passageways increase in size.

33 Claims, 4 Drawing Sheets

MUZZLE BRAKE

This application is a continuation of application Ser. No. 07/084,374, filed Aug. 11, 1987, now abandoned, which application was a continuation-in-part of U.S. application Ser. No. 798,866, filed Nov. 18, 1985, and now abandoned.

BACKGROUND OF THE INVENTION

This invention relates to muzzle brakes to reduce recoil when firing a projectile from a launch tube. More particularly, the invention relates to a muzzle brake which controls dissipation of the propulsion gases for improved recoil control, and which provides a series of impingement surfaces upon which the gases act to overcome recoil effects.

When a projectile is fired from a closed-end launch tube, such as a bullet traveling from a gun, there is a recoil effect on the tube. This effect arises from the explosive expansion of the propellant within the tube to propel the projectile from the tube. The recoil force is influenced by a number of factors, including the weight of the launch device, the volume of gases, the velocity of the gases, and the weight of the projectile pushed through the launch tube. The recoil delivers a sharp forceful blow to the firing device and pushes the gun in a rearward direction. The barrel of a gun during recoil may also change its orientation with respect to its initial position when fired. Typically, the muzzle of the gun will lift. If aiming at the same target, the gun must be brought to bear and resighted. Unless controlled or otherwise provided for, recoil can materially affect the accuracy and usefulness of a gun.

Various devices have been proposed to provide recoil control for guns. U.S. Pat. No. 858,745 describes a plurality of openings in the gun barrel extending back from the muzzle. The openings preferably present surfaces at right angles to the bore of the barrel upon which gases rushing forward through the bore impinge. The patent explains the openings may be of any desired form and cross-section and preferably increase in size as they near the muzzle end of the barrel.

U.S. Pat. No. 2,453,121 issued to Cutts describes annular ribs which define successive expansion chambers in a gas porting device which attaches to a shotgun muzzle. Ports of various sizes are provided in the wall of the cylindrical device to permit escape of propellant gas.

U.S. Pat. No. 2,567,826 issued to Prache describes a muzzle recoil check for firearms. A muzzle recoil cylinder screws on the muzzle of the barrel and has two substantially rectangular lateral openings formed in the side of the cylinder. Various plates slide onto the cylinder. These plates include deflecting wings having concave surfaces which form gas guide vanes. These wings project laterally from the side of the recoil cylinder adjacent to the lateral openings. Gases flowing through the openings impinge on and are directed rearwardly by the curved wing surfaces to obtain a reducing effect on the recoil of the firearm.

These and other known muzzle recoil devices do not fully take advantage of the compressed gases expanding within the barrel and the explosive expansion of gases through openings in the recoil device. It has been observed, for example, that known muzzle brakes customarily exhaust the gases prematurely. In short, known muzzle brakes may reduce recoil, but the reduction is limited and does not fully attenuate the recoil of a firearm.

The present invention better conserves the gas forces to permit impingement on a sequence of gas thrust surfaces, thus reducing recoil significantly.

BRIEF DESCRIPTION OF THE INVENTION

The present invention offers marked advantages over prior art systems of reducing recoil in firearms and related devices for propelling projectiles from launch tubes, including rifle barrels, pistol barrels and the like. In a broad aspect, the invention more fully exploits and conserves the exploding gas forces to reduce recoil by impinging the gases forward on an array of surfaces. The invention calls for a tubular brake which enables gases to escape through a plurality of expansion stages along the length of the brake. Each expansion stage includes circumferentially disposed gas vent apertures permitting gases to exit from the brake and a gas expansion chamber or plenum. The expansion plenums may be external and/or internal to the tube. In the case of rifles and the like, both external and internal expansion chambers are preferred. The internal expansion plenums have reaction surfaces on which the expanding (but nevertheless, compressed) gases impinge and try to reverse direction, thus, contributing to a reduction in recoil. The exterior chambers or plenums receive the gases which vent forward into the chambers or plenums. The exploding expanding gases impinge forwardly on reaction surfaces in the exterior plenums and vent as a jet thrust rearwardly to the atmosphere. Both the forward impingement and the rearward jet thrust have a counter-recoil effect and contribute to the overall reduction in recoil.

The invention conserves and exploits the energy of the propellant gases in the brake by distributing the venting gases among the expansion stages, such that the reaction surfaces in each gas expansion stage experience substantial forward thrust forces. It is preferable that the reaction surfaces in each stage experience approximately equal thrust forces. It is important that substantially all of the gases not be vented through the first one or two stages, but instead be vented nearly equally through all of the stages. Each stage thereby provides a part of the overall counter-recoil force, and the total counter-recoil force increases markedly. To do this, it is generally necessary that the brake restrain and conserve the exploding gas by sizing the vent apertures or the expansion plenums with respect to their adjacent apertures or plenums, or by a combination thereof. Thus, successive stages increase in volume towards the muzzle end of the brake, or the vent apertures from the tube increase in size toward the muzzle end, or both the stages and the apertures increase in size.

The external expansion plenums or chambers preferably have circular plates or reaction surfaces which are disposed transversely to the axis of the brake, and which extend to an outer skirt which turns back toward the breech or entry end of the brake. In the case of rifles and other launch tubes which shoot ballistic-type projectiles like bullets, shells, or rockets, the outer expansion chambers may take the appearance of caps. These may have a flat surface which extends radially out from the brake and a circumferential skirt surface which curves or otherwise extends back towards the entry end of the brake. The outer surface of the skirt may be parallel to the brake axis and appear like a cylinder. The inner skirt surface, however, preferably is tapered to expand toward the entry end of the brake. The inner skirt surface, accordingly, preferably takes the appearance of a conical frustrum. The angle of taper is preferably between about 10 and about 50 degrees, especially about 40 degrees, to the axis of the brake so that gases are not directed directly toward the user of the brake. Embodiments which do not have exterior plenums exhaust gases through passageways rearwardly at an angle between about 10 and about 50 degrees with respect to the longitudinal axis of the brake.

In the case of a brake for a shotgun or other weapon shooting shot or shot-like projectiles, the surfaces defining the external plenums or expansion chambers preferably curve toward the entry end of the brake as they extend radially outward from the brake. The compressed propellant gas expands and vents from the interior of the brake, and impinges on the external radially extending, longitudinally spaced surfaces. These surfaces in cross section may resemble a series of shallow dishes or bowls, and adjacent surfaces define gas expansion plenums into which the compressed propellant gases vent and expand explosively. The longitudinal spacings between successive outer surfaces preferably increase toward the muzzle end of a brake so as to help the brake meter the use of the propellant gas forces.

The inner wall surface of the invention is preferably cylindrical in shape. For a shotgun or similar weapon, the inner wall surface of the launch tube is preferably continuous from the entry or breech end of the brake to the exit or muzzle end of the brake. For a rifle, artillery weapon or similar launch tube firing a ballistic-type shell, the inner wall surface of the brake is preferably interrupted along its length by transverse plates—i.e., plates disposed transversely relative to the axis of the brake. These plates may have spacings which increase toward the muzzle of the brake; however, it is generally preferred that they remain about the same. It is necessary that each plate have a central opening or bore which is aligned with the axis of the brake and is large enough to pass a projectile. It is preferred that the periphery of each plate which defines its central bore be a sharp edge, since this configuration enables gas flowing through the central bore with the projectile to cushion the flight of the projectile with a boundary layer of gas. The forward reaction surface of each interior plate on which the gas impinges is preferably roughened to extend the contact time of the compressed gas on the reaction surface and thereby increase the counter-recoil effect of the surface. It is especially desired that all of the gases exit the brake through the expansion stages, rather than through the muzzle of the brake.

In the case of rifles, artillery and similar ballistic-type shell launch tubes, longitudinally spaced sets of circumferentially spaced passageways or apertures in the walls of the brakes of the invention enable the propulsion gases to escape into the exterior expansion chambers. The diameters of the apertures in the circumferential sets of passageways preferably increase as the sets are located closer to the discharge end of the muzzle brake. The passageways are preferably aligned forwardly between about 40 degrees and about 60 degrees to the axis of the muzzle brake, although in the last stage the set of passageways may be aligned about normal to the muzzle brake axis. Preferably, the angle for the alignment of the passageways is about 60 degrees to the axis of the brake. The escaping gases, being directed forward in all but the last stage, impinge forwardly on the outwardly extending reaction surfaces of the external plenums or expansion chambers and thereby create a reaction against the normal recoil force. The passageways are preferably conical to have a wider inlet than outlet and thus preferably decrease in size toward the exterior of a brake. The conical apertures define venturi-like exhausts for the gases venting from the muzzle brake. In the case of shotguns, however, the above described openings preferably take the form of circumferentially spaced, longitudinally disposed slots which expand circumferentially in width toward the muzzle end of a brake.

In another view of the present invention, the exterior expansion plenums receive metered portions of the explosively expanding gas venting from within a muzzle brake. For a dry nitroglycerine-base type propellant, the exploding gas expands volumetrically on the order of 14,000 to 1 over the dry weight volume. Each expansion plenum or chamber defines a forward reaction surface on which the gas impacts. This impingement, together with the metered passageways, restrains the gas inside the muzzle brake for a metered venting into a subsequent expansion plenum. This impingement creates a reaction to the normal recoil effect. Further, exhaustion of these rapidly expanding gases to the atmosphere as a jet thrust from the plenum also creates a reaction to the normal recoil effect. The expansion plenums are sized such that substantially all of the propellant gas preferably exhausts to the atmosphere from the muzzle brake through the expansion plenums before a projectile exits the brake.

The invention is considered to have particular application to small firearms such as rifles, revolvers, shotguns, and automatic weapons. It is further considered, however, to have application to much larger weapons which employ launch tubes. These larger weapons include cannons, missile launchers, naval guns, etc. All of these weapons employ rapidly expanding gases to propel a projectile from a launch tube. Embodiments of the invention may threadedly engage with the muzzle of the launch tube, or may be integral with the barrel at its muzzle end.

The present invention in one aspect provides a muzzle recoil brake containing a plurality of inner plates transversely positioned and axially spaced in the interior bore of the muzzle brake to define a series of internal expansion chambers. Each plate has a longitudinally bored thrust reaction surface upon which the gas of the exploding propellant impinges. Apertures in the wall of the muzzle brake exhaust the expanding gases from the internal expansion chambers onto exterior secondary reaction surfaces. Each such secondary surface is defined by a cap-like reaction surface which connects to the exterior periphery of the muzzle brake. The apertures help to restrain the expanding gas within the muzzle brake, such that substantially all of the gas vents through the apertures before the projectile exits the brake. In effect, the apertures act in combination with the reaction surfaces to meter the gas from the expansion chambers and provide a counter-recoil force. Preferably, the apertures exhaust gas forward toward the muzzle end of the brake where the gas impinges on the secondary reaction surfaces, reverses direction, and exits to the atmosphere toward the inlet end of the brake. It is generally preferred that the apertures increase in size in successive stages toward the exit end of the brake. The apertures in the last stage may discharge at about right angles to the axis of the brake or may discharge forwardly, but in any event, should be sized to vent substantially all of the remaining gas before the projectile exits the brake.

Each inner plate and its associated external expansion plenum or chamber define a stage having dual reaction surfaces. Impact of the gas on the dual reaction surfaces in each stage helps to reduce recoil with greatly improved effectiveness. The inner plate preferably defines a chamfered bore sized to permit passage of the projectile. The inner plate preferably is dished towards the muzzle end of the brake. Further, the plate surfaces upon which the compressed gases impinge are preferably roughened to help restrict the flow of the gas across the surface, and thereby retard the flow of the gases through the brake. This also increases the counter-recoil action of the brake.

In another aspect, the present invention provides a muzzle recoil brake containing a plurality of transversely positioned and axially spaced exterior reaction surfaces to define a series of exterior expansion plenums or chambers. For a shotgun-type weapon it is preferable that one or more longitudinal slots vent gases through the wall of the brake. The principle that the apertures in the wall of a brake increase in size progressively towards the muzzle brake discharge applies to the slot-type passageways as well. Thus, each such slot preferably becomes progressively circumferentially wider toward the muzzle end of the brake. In the case of a brake for a shotgun or other weapon firing a shot-type shell, the volumes of the exterior plenums or chambers preferably increase as they approach the muzzle end of a brake. The slots effectively act in combination with the plenums to meter the gas from the muzzle brake, such that all of the stages receive a portion of the expanding gases. The expanding gases impinge forwardly on the expansion plenum reaction surfaces, and thus reduce recoil significantly.

In general, it is desired that a muzzle brake of the invention for a weapon, such as a rifle, using ballistic-type projectiles, have at least three stages and preferably about ten stages. Effectiveness of the brake, in general, increases with the number of stages. For weapons such as rifles and handguns shooting ballistic projectiles, ten stages offer marked advantages over lesser numbers of stages. For shotguns or similar weapons shooting shot-type shells more than ten stages are preferable—i.e., between about 28 and 36 stages, and especially about 32.

The sequence of stages in a muzzle brake of the invention acts to distribute the discharge of expanding gases over all of the stages. Thus, the succeeding stages have apertures of successively greater openings, or have successively greater volumes, or have combinations of such features. Conversely, the stages nearer to the inlet or breech end of the brakes have smaller apertures and external plenums so as to divert gases toward the later stages.

As stated earlier, it is preferred that all of the propulsion gases be exhausted from the brake before a projectile clears the muzzle of the brake. To help assure this result, the apertures in the last stage preferably discharge laterally from the brake rather than toward the muzzle so as to help clear the brake of the gases. These apertures may further be of a substantially larger diameter than the apertures of preceding stages. The resulting lower resistance to flow of the gases facilitates their timely exhaust.

In all types of brakes it is preferable that no wall openings be located along the bottom of the brake, since gases escaping at this location would increase the tendency of a weapon to tilt upward after firing a projectile.

BRIEF DESCRIPTION OF THE DRAWINGS

The invention will further be described by reference to the accompanying drawings which illustrate particular embodiments of a muzzle brake apparatus for reducing recoil in accordance with the present invention. Like members in the drawings bear like reference numerals.

DESCRIPTION OF THE PREFERRED EMBODIMENTS

Figures 1A, 1B, 2, 3, 4:
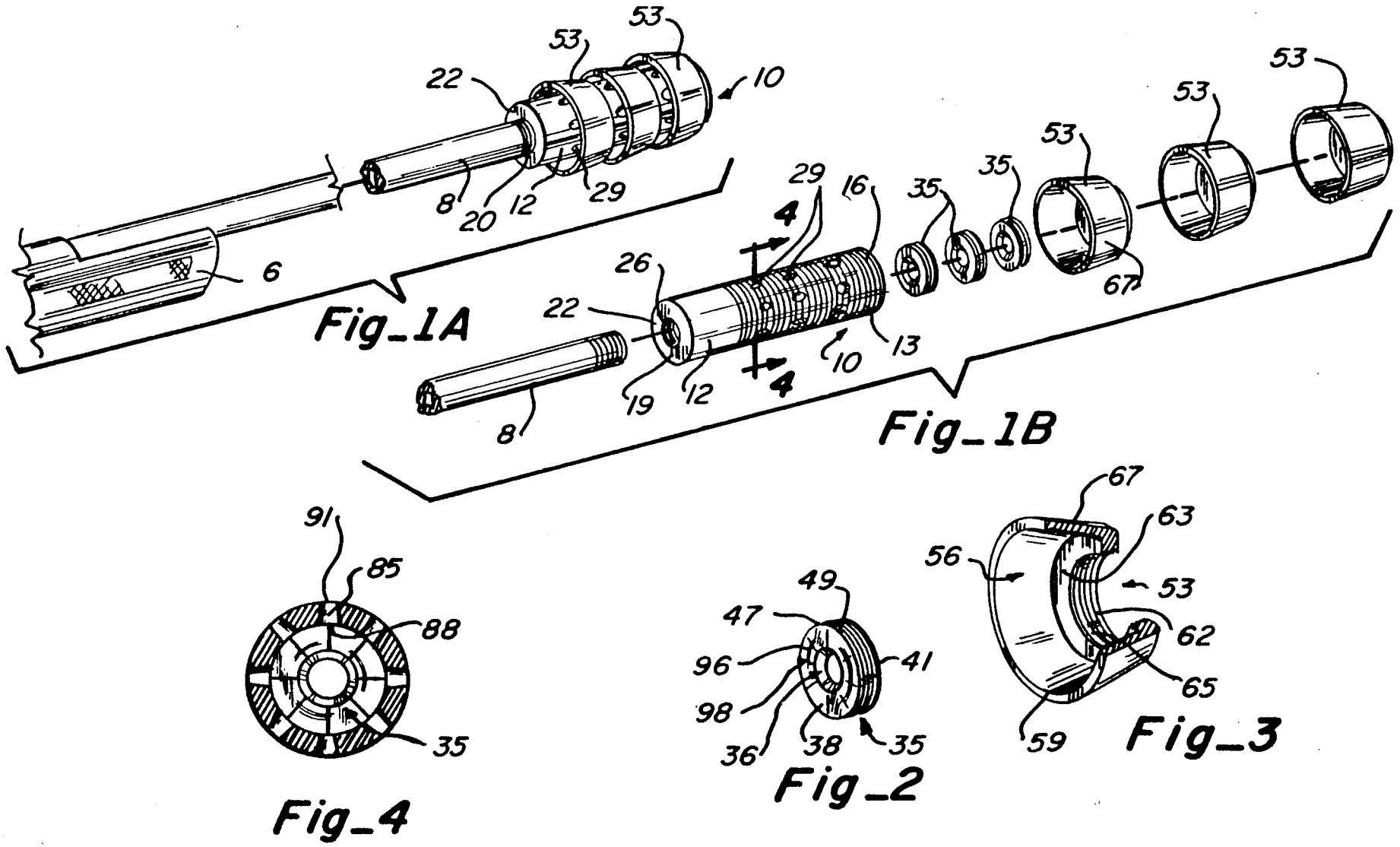
FIG. 1A is an orthographic view of a muzzle brake of the present invention installed on the muzzle of a rifle.
FIG. 1B is an exploded view of a muzzle brake in accordance with the present invention.
FIG. 2 is an orthographic view of an inner reaction surface or plate which defines an expansion chamber within the muzzle brake.
FIG. 3 is an orthographic view of a cap-like external reaction surface according to the present invention which defines a secondary impingement surface or plenum for gases exiting the expansion chambers with a cut-away portion to illustrate the threaded bore of this surface.
FIG. 4 is a cross-section view of the muzzle brake tube of FIG. 1B, illustrating the tapered venturi apertures taken along lines 4—4 in FIG. 1B.

The components and preferred embodiments of the invention will be described with specific reference to the drawings briefly described above. Turning first to FIG. 1A, there is illustrated in perspective view a rifle-type device 6 having a barrel 8 which is capable of firing ballistic-type projectiles. Attached to the barrel is a muzzle brake 10 of the present invention. It is noted here that embodiments of the invention may be gainfully used to reduce recoil on a wide variety of projectile firing devices, and the rifle 6 is but one useful application for the invention.

FIG. 1B depicts the principal components of a muzzle brake of the invention. The components comprise a bored tube 12, a plurality of plates 35 and a plurality of external reaction surfaces 53. As shown in exploded view, the muzzle brake 10 is a tube 12 having a thread 13 which is in the exterior wall surface of the tube 12. A first or breech end 19 includes a muzzle connector 22 which is defined by a threaded bore 26 extending along the longitudinal axis of the tube 12. The second or muzzle end of the tube 12 defines a projectile exit 16. The thread 13 extends along the exterior surface of the tube 12 from the brake exit 16 almost to the muzzle connector end 19.

A series of circumferential sets of apertures 29 are spaced along the tube 12. The apertures 29 define passageways which extend through the tube 12 from an inner bore 32. The inner bore 32 (best viewed in FIGS. 5 and 6) extends from the brake exit 16 along the longitudinal axis of the tube 12 to the interior transverse edge 25 of the bore 26. The inner bore 32 has a thread 34. The diameter of the inner bore 32 is greater than the diameter of the connector bore 26 which is greater than the diameter of the muzzle bore.

Turning to FIG. 2 there is illustrated in perspective view an interior plate 35 which, when installed in the tube 12 together with an adjacent interior plate 35, defines an internal expansion chamber for the propellant gases. The plate 35 of the illustrated embodiment is a thin cylinder or disk having a diameter greater than its height or thickness. The plate 35 is preferably dished in cross-section view toward the projectile exit 16 end of the brake 10. A bore 36 about equal to the diameter of the muzzle bore extends along the longitudinal axis of the plate 35. A reaction surface 38 is defined by one end surface of the plate 35. The surface 38 is substantially planar, although in a preferred embodiment is a rough surface configured to retard gas from across the surface. Thus, grooves 96 spiral from the edge of the plate 35 towards the bore 36 and radial grooves 98 intersect the grooves 96. The grooves 96 and 98 cooperate to form a roughened surface 38. When the plate 35 is installed in the tube 12, the upstream surface 38 is transverse to the longitudinal axis of the tube 12 and faces towards the muzzle 8. The downstream surface 41 of the other end of the plate 35 defines an exit face and preferably includes two aligned, radially extending grooves 44 and 45. The cylindrical exterior wall surface 47 of the plate 35 includes a thread 49 which matches the thread 34 of the inner bore 32. The bore 36 preferably is chamfered on the reaction surface 38 and the downstream surface 41 to a knife edge medial those surfaces.

Illustrated in perspective view in FIG. 3 is an external cap-like plenum structure 53 which defines a secondary reaction surface 56 of the present invention. The cap 53 forms a plenum for expansion of the gases venting through the aperture 29 from the interior of the muzzle brake. The cap 53 has an open gas discharge end 59. The opposing end has a threaded bore 62. The cutaway in FIG. 3 illustrates the thread 65 of the bore 62, which matches the thread 13 on the exterior surface of the tube 12. Since the internal diameter of the cap 53 at the bore 62 exceeds the diameter of the tube 12, a planar ring surface 63 extends between the bore 62 and the skirt or wall portion 67 of the cap 53. Similarly, the diameter of the discharge end 59 exceeds that of the bore end 62.

The interior surface of the skirt 67 of the cap 53 is preferably frustoconical and extends outwardly between 10 and 50 degrees with respect to the longitudinal axis of the cap 53. In a preferred embodiment, the surface 67 extends outwardly about 40 degrees with respect to the longitudinal axis of the brake. In an alternate embodiment not illustrated, the cap 53 may comprise a simple open-ended cylinder. The annular ring surface 63 together with the interior surface of the skirt 67 define a secondary reaction surface 56. The length of the cap 53 is sufficient to extend substantially the distance between adjacent circumferential sets of apertures 29. One embodiment not illustrated includes a plurality of longitudinally arranged L-shaped flanges which extend from the open edge of the skirt 67. When the caps 53 are assembled on the tube 12, the flanges of each cap 53 contact the exterior surface of the ring 63 of the next adjacent cap 53 and act to separate adjacent caps.

In a preferred embodiment illustrated in FIG. 4, the passageways 29 of the present invention define orifices or venturi ports 85 in the tube 12 which direct the exhausting gas more forcefully onto the secondary impingement surface 56. FIG. 4 depicts in cross-section the tapered apertures 85 which form the venturi ports 85 in the tube 12. These preferred ports 85 are conical such that the diameter of the inlet 88 is larger than the diameter of the outlet 91. Typically the diameters of the inlet ports 88 will be equal. Similarly, the diameters of the outlet ports 91 will also be equal but smaller than the diameter of the inlet ports 88. However, in a preferred embodiment, the diameters of the inlet ports 88 and the outlet ports 91 in a given circumferential set will be less than the corresponding diameters of the venturi apertures 85 in the circumferential sets closer to the bore exit 16. This staged metering of exhaust gases permits retention and use of the gas forces on as many of the stages of dual gas reaction surfaces 38 and 56 as feasible. At the same time, however, it is important that the gas in the muzzle brake be substantially totally exhausted through the apertures 85 before a projectile travels through the muzzle brake exit 16. This maximizes the forward thrust created by the gases impacting the reaction surfaces of each stage and substantially eliminates the recoil.

Figure 8:
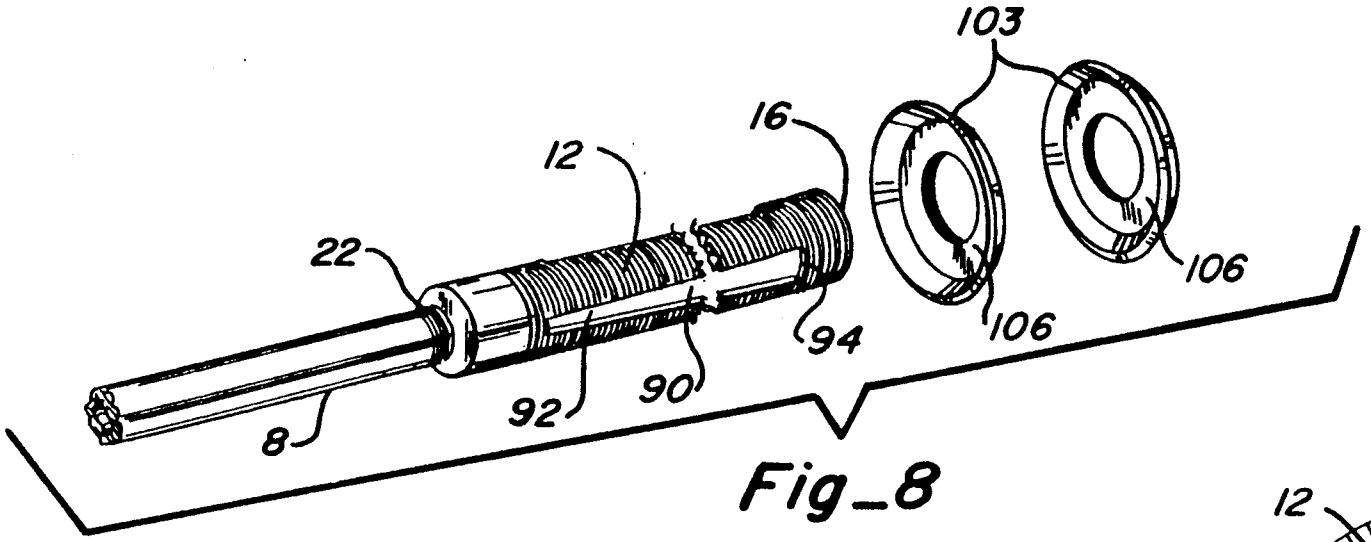
FIG. 8 is an exploded orthographic side view of an alternate embodiment of a muzzle brake having an aperture which is a tapered slot extending longitudinally along the wall of the muzzle brake.

An alternate embodiment for the gas vent apertures 29 is illustrated in FIG. 8. This embodiment replaces the plurality of sets of circumferential apertures 29 with a plurality of circumferentially spaced, longitudinally tapering slots 90 in the wall of the tube 12. The slots 90 taper from a narrow opening 92 near the muzzle connector end 22 to a wider opening 94 at the brake exit end 16 of the tube 12. Exterior plates 103 mount to the exterior of the tube 12 to define gas impingement surfaces 106 and when assembled, to define gas expansion plenums 104.

Figure 10:
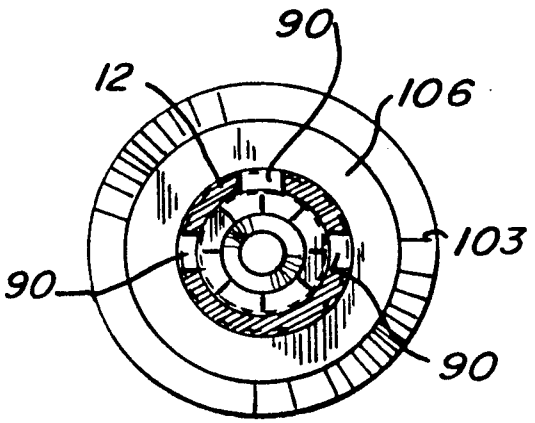
FIG. 10 is a cross-section view of a muzzle brake for shotguns taken along lines 10—10 in FIG. 9.

FIG. 4 further illustrates that the series of apertures 85 are preferably not uniformly spaced around the circumference of the tube 12. As explained earlier, the muzzle of a gun which is fired tends to rise upwards. Any positioning of the apertures 29 or 85 so that gas may exhaust downward increases the upward kick. Accordingly, preferred embodiments of this invention space the apertures 29 or 85 on the sides and upper exterior surface of the tube. A similar arrangement principle is appropriate for the tapered slot as illustrated in the cross-section FIG. 10 which is taken along lines 10—10 of FIG. 9. FIG. 10 shows a plurality of tapered slots 90 in the sides and upper portion of the tube 12.

Preferably, the slots 90 and apertures 29 do not occupy the lower portion of tube 12.

Figure 5:
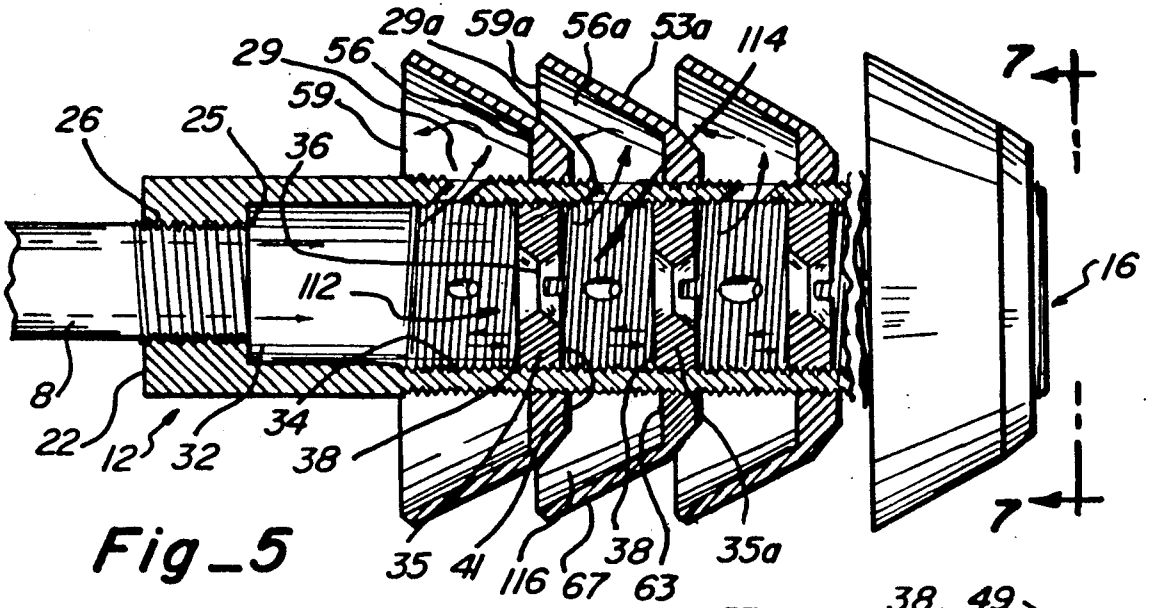
FIG. 5 is a cut-away view of a muzzle brake as depicted in FIG. 1A, illustrating the placement of the interior plates with respect to the external plenums and the chamfered bore of the interior plates.

FIG. 5 is a partial cutaway view of a muzzle brake 12 as shown in FIG. 1A with one circumferential set of apertures 29 for each stage. The arrows designate the directions of gas flow in the muzzle brake, which include impingement on the interior plate 35, flow through the bore 36 and flow through the passageways 29 with impingement on the secondary reaction surface 56 and exhaustion from the cap 53 through the port 56.

The cutaway portion of FIG. 5 illustrates the placement in one embodiment of the interior plate 35 with respect to its associated exterior cap 53. The exit face 41 of the inner plate 35 preferably is placed as close as possible to the inlet ports of the adjacent apertures 29 in the inner bore 32, although the spacing between adjacent plates 35 is partially dependent upon the propellant and amount used and the projectile fired through the muzzle.

Preferably, the bore 36 of the plate 35 is about 0.004 to about 0.025 inches greater in diameter than the diameter of the projectile and is chamfered from both the reaction surface 38 and the downstream surface 41 to a sharp edge. The oversize bore permits a portion of the gases to accompany the projectile through the bore 36, and the chamfer edge promotes laminar flow of the gas around the projectile. It appears that a blanket of compressed gas thereby surrounds the exterior surface of the projectile to cushion its longitudinal travel through the muzzle brake.

The cutaway view in FIG. 5 illustrates how the inner plate 35 defines a first internal expansion chamber 112 in the inner bore of the muzzle brake 12. The aperture 29 permits a portion of the propellant gases to vent forward into the expansion plenum defined by the cap 53 and impinge upon the secondary reaction surface 56. The adjacent inner plate **35*a* defines a second internal expansion chamber 114 of the muzzle brake 12. The apertures 29*a* meter a portion of the propellant gases into the plenum defined by the exterior cap 53*a*. These gases impinge upon the secondary surface 56*a* before exhausting from the open end of the cap 59*a*. The third internal expansion chamber of the muzzle brake 12 in FIG. 5** is not illustrated in the cutaway view.

Figure 7:
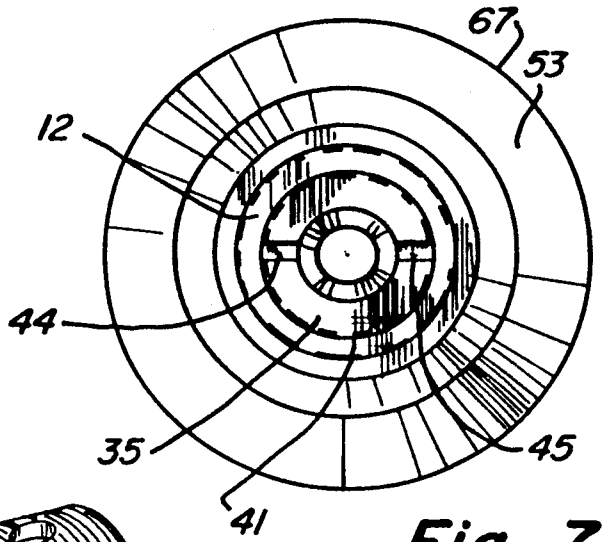
FIG. 7 is a cross-section view of the muzzle brake illustrated in FIG. 5 and taken along lines 7—7.

FIG. 7 is a cross-sectional view taken along lines 7—7 of FIG. 5. Grooves 44 and 45 are aligned and extend radially in the downstream or exit face of the inner plate 35. The exterior cap 53 is connected to the tube 12.

Figure 6:
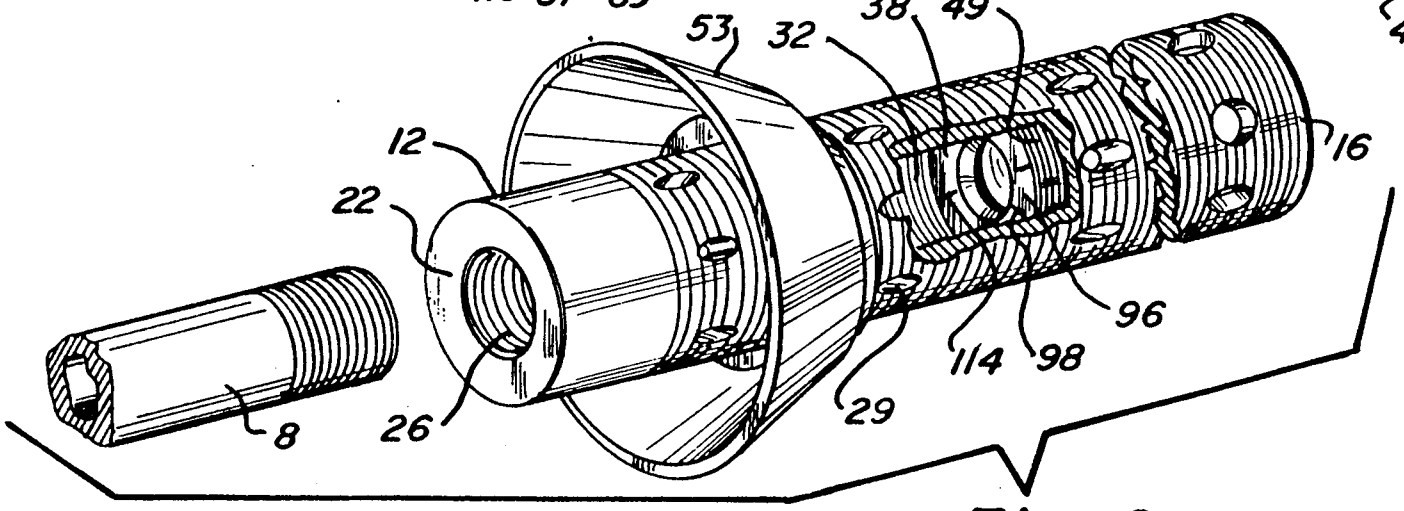
FIG. 6 is an orthographic cut-away view of a muzzle brake illustrating a phantom view of the dual reaction surfaces in a first reaction stage defined by an interior plate and an exterior expansion plenum; a partial cut-away view of an inner plate which defines an adjacent, second internal expansion chamber; a phantom view of the muzzle brake exit plate which defines a third internal expansion chamber; and the exterior expansion plenums for the second and third stages are not illustrated.

Turning now to FIG. 6, there is illustrated an alternate embodiment of the muzzle brake 12 of the invention. This embodiment has two circumferential sets of apertures 29 for each stage. FIG. 6 illustrates in phantom the first stage including the internal expansion chamber 112 defined by the inner plate 35 and the exterior expansion chamber or plenum defined by the exterior cap 53. The cutaway portion of FIG. 6 illustrates the adjacent interior expansion chamber 114 defined by the adjacent interior plate 35. The impingement surface 38 includes spiral grooves 96 and radial grooves 98 to make a roughened surface 38. The thread 49 on the cylindrical surface of the plate 35 engage matching thread of the interior bore 32. The third interior expansion chamber adjacent to the muzzle brake exit 16 is illustrated in phantom.

Figure 9:
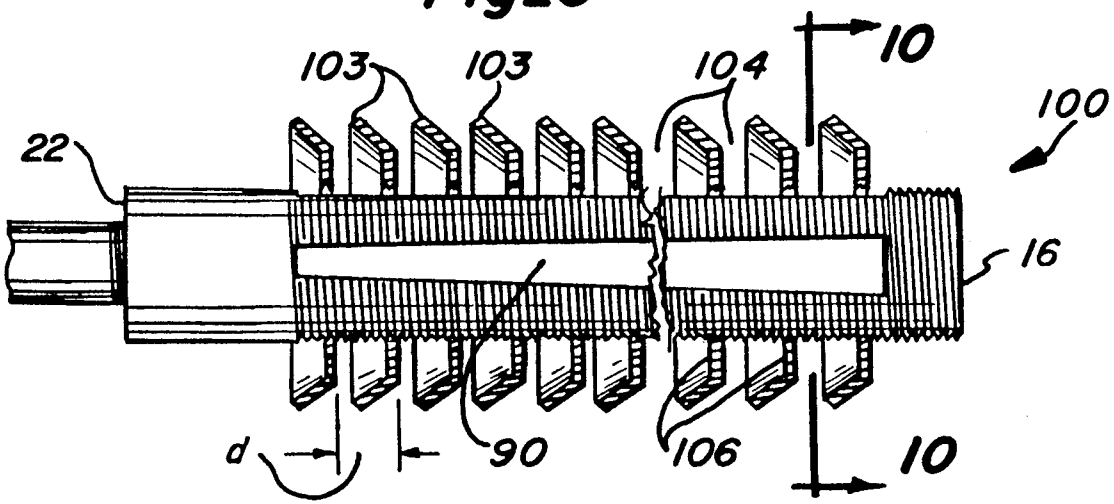
FIG. 9 is a cross-section side view of a muzzle brake adapted for use with shotguns, and illustrating the increased expansion plenum volume defined by the exterior plates or reaction surfaces.

FIG. 9 illustrates a muzzle brake 100, according to the present invention, for a shotgun. This embodiment replaces the metered apertures 29 with tapered apertures 90 as illustrated in FIG. 8. The dual reaction surfaces defined by the inner plates 35 and the caps 53 are replaced with a plurality of exterior reaction surfaces or plates 103.

The adjacent plates 103 define external expansion chambers or plenums 104 for the vented gases. The inner surfaces 106 of the plates 103 define impingement reaction surfaces which are impacted by the rapidly expanding vented gases. In this embodiment, the gases vent outwardly about normal to the brake's longitudinal axis. In cross-section the plates 103 appear as shallow dishes or bowls, and the gases exhaust from the plenums 104 rearwardly between about 10 and 50 degrees relative to the brake's axis. The distances between sets of adjacent plates are metered to control the exhaustion of gases to the atmosphere. In general, it is desirable that successive stages in a series of stages grow in volume such that the gas expansion plenum 104 is greater for those plates 103 closer to the muzzle brake exit 16 then those plenums towards the muzzle connector 22.

One embodiment for a shotgun which accomplishes this goal positions the plates at progressively greater distances of separation. For example, the distances between successive plates in a series of plates should preferably increase such that the next adjacent plate towards the muzzle brake exit 16 is an additional 1/Y times the distance between the first two plates when compared with the distance between the adjacent preceding plates, where Y is the number of plates in the muzzle brake. Using the distance between the first two plates as a base B, the distance $D_N$ between a subsequent plate N and its adjacent plate may be determined by computing $D_N = B \times (1 + (N-2)/Y)$, where N is a plate number greater than or equal to 3 for which the distance is being computed; B is the base distance between the first two plates; and Y is the number of plates in the muzzle brake. An especially preferred sequence of plates in a brake about four inches long for a 12 gauge shotgun is one in which the number of plates is about 32, each plate is about 1/32 inch in thickness, and the distance between the first two plates is about 0.05 inch.

An alternate embodiment uses the tapered slots 90, but positions the plates 103 in approximately equal distances of separation. The angle at which the skirt 103 exhausts gas from the plenum 104 increases for plates closer to the muzzle brake exit 16. In a cross-section view, a plate near the muzzle of the gun would appear as a bowl having a sidewall at about 10 degrees, while a plate towards the brake exit would appear as a bowl with sidewalls angled about 50 degrees. A greater angle provides a larger exhaust port between adjacent plates. In this manner, the jet thrust exhaustion of gases from the plenum may be metered so as to restrain the flow of gases from the muzzle brake. An alternate embodiment may eliminate the tapered slots 90 and use finely drilled circumferential sets of passageways through the wall of the muzzle brake, similar to those passageways discussed earlier.

Figure 11:
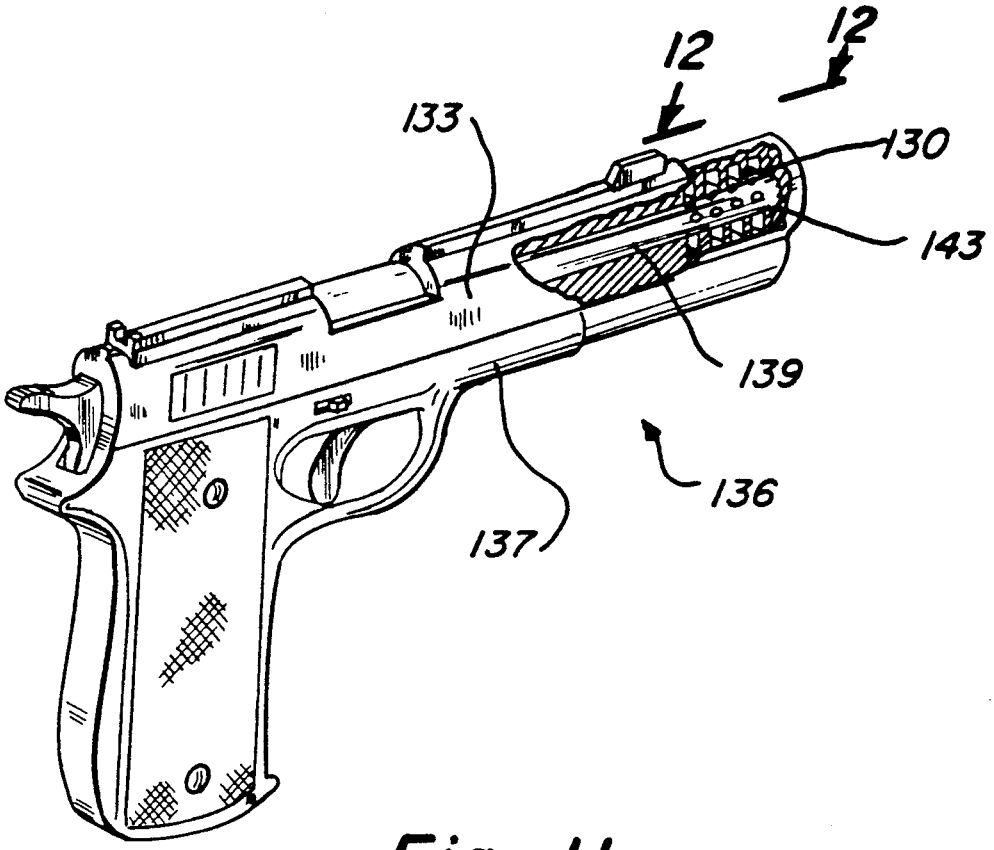
FIG. 11 is a orthographic view of a recoil brake integral with the muzzle of an automatic pistol.
Figure 12:
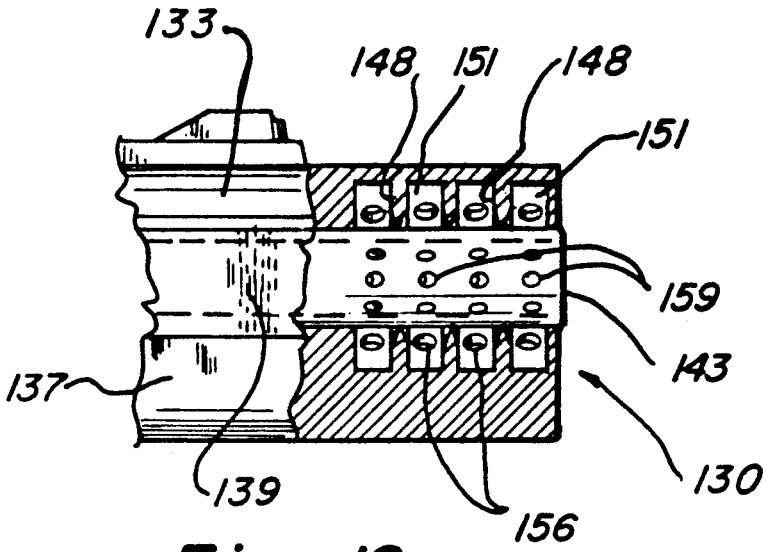
FIG. 12 is a cross-section view of a recoil brake integral with the muzzle of an automatic pistol as illustrated in FIG. 11, taken along lines 12—12.

FIG. 11 illustrates an embodiment of the invention in which the recoil brake 130 is integral with a slide receiver 133 of an automatic weapon 136. Typical automatic weapon such as the one illustrated have a slide receiver 133 which moves longitudinally with respect to the gun frame 137. When an automatic weapon is fired, the propellant gases also cause the slide 133 to retract. This mechanical movement ejects a spent cartridge, loads a new cartridge, and cocks the weapon for subsequent firing. The barrel 139 illustrated in phantom extends to the muzzle exit 143. Turning now to FIG. 12, longitudinally spaced reaction surfaces 148 may be machined or forged into the interior sides of the slide receiver 133 which surrounds the barrel as a shroud. In an alternate embodiment, the surfaces 148 are threaded to the exterior of the barrel 139, and the slide receiver 133 forms a shroud around the plates to enclose the muzzle brake. The reaction surfaces 148, together with the sides of the slide receiver 133, define expansion plenums 151 around the barrel 139 of the weapon. The barrel 139 includes axially spaced circumferential sets of apertures 159. These apertures define passageways from the interior of the barrel 139 and are angled forwardly between about 40 and about 60 degrees with respect to the longitudinal axis of the barrel 139. The passageways 159 may be a venturi-type and communicate propellant gases from the barrel 139 into the expansion plenums 151 and against the reaction surfaces 148.

Axially spaced sets of circumferentially disposed apertures 156 in the side of the slide receiver 133 communicate the rapidly expanding propellant gases from the expansion plenums 151 to the atmosphere. These apertures 156 may be angled rearwardly between about 10 and about 50 degrees relative to the axis of the barrel 139. These apertures 156 may also be of a venturi-type design, having a larger inlet than outlet.

The various parts of the present invention may be assembled in several ways to permit use of the recoil muzzle brake. As illustrated in FIGS. 5 and 6, the plate 35 engages the thread 34 of the inner bore 32 and is screwed into the bore 32 between two adjacent sets of circumferential apertures 29. Spacing of the apertures and thus spacing of the impingement surfaces depends on the propellant used. In general, the greater the volume of gases formed, the greater the spacing. Also, a larger gun bore will normally require additional room in the expansion chambers.

Returning to FIGS. 5 and 6, other plates 35 are similarly threaded into the inner bore 32 and placed between adjacent sets of circumferential apertures 32. The grooves 44 and 45 (best illustrated in FIG. 7) permit use of a screwdriver or other implement to turn each plate 35 in the inner bore 32. Successive plates 35 threaded into the inner bore 32 of the tube 12 define the expansion chambers 112 and 114, for example, for the exploding gases of the propellant. The impingement surface 38, illustrated in FIG. 2, preferably is a roughened surface created by a spiral grove 96 and radial groves 98 in the surface 38. This roughened surface defined by the crosswise pattern provides a more resistant flow path for the compressed gases than does a smooth surface. Other indentions and patterns which roughen the surface may also be used to provide a resistant flow path for the gases and tend to hold the gas a fraction of a second longer on the surface 38. This increases the forward impact which reduces recoil.

Sequencing the inner plates 35 in an embodiment of the invention especially adapted for shot is an important consideration. Such an embodiment preferably has a plurality of inner plates 35, but the bore 36 in the plate 35 closest to the muzzle connector 22 is larger than the muzzle bore of the gun. The bore 36 in each subsequent plate 35 inserted into the tube 12 is narrower than its predecessor and finally narrows to a bore about equal to the muzzle bore. Shot propelled from this embodiment accordingly may be expected to be much more concentrated and directed than when fired from a similar gun without this type of muzzle brake.

The cap 53 having its open gas discharge end 59 facing the muzzle connector end 22 is threaded onto the exterior surface of the tube 12. The cap 53 is threaded onto the tube 12 so that the transverse ring surface 63 between the threaded bore 62 and the frustro skirt 67 of the cap 53 is between adjacent series of circumferential apertures 29. A similar cap is threaded to the exterior of the tube 12 and positioned radially adjacent to each inner plate 35 threaded into the inner bore 32 of the tube 12. The inner surface of the skirt 67 and the ring 63, together with the exterior surface of the tube 12, define the secondary expansion chamber or plenum 116 of the cap 53.

In one embodiment of the present invention, the flanges 69 extend from the open edge of the cap skirt 68. These flanges 69 contact the exterior surface of the ring 63 of the previous adjacent stage and help align the caps 53 with respect to each other and with respect to the caps' associated interior plates 35.

In operation, again referring to FIG. 5, the muzzle brake 10 is threaded securely onto a gun muzzle 8 at the muzzle connector 22. In an alternate embodiment, the muzzle brake is integral with the barrel of the launch tube. When a projectile is fired through the muzzle, the propulsion material explodes into compressed gases which propel the projectile through the muzzle. The gas materials expand at a high rate. As the projectile passes through the bore of the inner plate 35, the compressed propellant gas impacts the impingement surface 38 of the plate 35. In a preferred embodiment, the surface 38 is roughened so as to encourage the gases on the surface 38 to remain there a fraction of a second longer, and thus maximize the benefits of the recoil counter force on the surface 38. As previously mentioned, FIGS. 2 and 6 illustrate an embodiment having spiral groves 96 in the surface 38 of the inner plate **35*a* with radial grooves 98 scoring across the spirals 96. These grooves 96 and 98 create a roughened impact surface 38** considered to be quite effective in retarding gas flow.

A portion of the gases in the internal expansion chamber vent forward through the apertures 29 in the tube 12. These gases pass forward through the apertures 29, explosively expand and impact the secondary reaction surfaces 56. For a dry nitroglycerine type of propellant, the gases will expand volumetrically some 14,000 to 1 over the dry powder volume. The gases impacting these dual reaction surfaces 38 and 56 therefore impart a forward thrust on the muzzle brake and act to overcome recoil. The exhausted gases rebound from the secondary reaction surfaces 56 and exit the caps 53 through the open gas discharge ends 59 as a jet thrust.

While a projectile is substantially blocking the bore through a given plate 35, the forces of propulsion are blocked from traveling into the next expansion chamber. The gases thereby release some of their energy while thus compressed by impacting the reaction surface 38. A layer of gas blankets the projectile as it travels through the launch tube. Additional energy is released from the expanding gases by impacting the secondary reaction surface 56. The gases deflect off the secondary reaction surface 56 and exit from the cap 53 through the open gas discharge end 59. The impact of the gases on the dual impingement surfaces 38 and 56 and the jet thrust exit of gases from the plenum contributes to lessening the recoil of the device firing the projectile.

The projectile continues at a high rate along the longitudinal axis of the tube 12 into the next adjacent internal expansion chamber (for example, 114) and through the adjacent plate 35*a*. The expansion chamber 114 provides space for the compressed propellant gases to expand. The gases here also impact the reaction surface 38 of the next plate 35*a* and a portion of the gas vents forwardly through the apertures 29*a* onto the secondary reaction surface 56*a* of the adjacent cap 53*a*. This process is repeated as the projectile travels along the longitudinal axis of the tube 12 and through the muzzle brake exit 16.

The apertures 29 communicating the compressed gases of propulsion from the final internal expansion chamber should be sized sufficiently to permit substantially all of the remainder of the expanding gases to exit this expansion chamber through the apertures. In following this criterion, a portion of the gases will vent at each expansion stage. In this way, most and preferably all of the explosive, expansive forces which create the recoil effect will be countered by impacting the various impingement surfaces 38 of the plates 35 in the inner bore 32 and by impacting the secondary impingement surfaces 56 of the various caps 53 disposed along the exterior surface of the tube 12.

Returning to FIGS. 11 and 12, when a projectile is fired from the automatic weapon shown there, the slide receiver 133 is forced rearwardly with respect to the frame 137 of the weapon 136. As the mechanical movement begins to occur, the projectile is rapidly moving through the barrel 139 and towards its target. The propellant gases vent forwardly from the barrel 139 through the circumferential sets of passageways 159 into the expansion plenums 151. The rapidly expanding gases impact the reaction surfaces 148 and exhaust in a jet thrust rearwardly through the apertures 156. The reaction surfaces 148 may be roughened to provide a resistant flow path for the gases and to hold the gases a fraction of a second longer on the surfaces 148. The forward impingement of gases on the surfaces 148 and the jet thrust rearwardly contribute to the total counter-recoil force of the brake 130.

As explained earlier, the angle of gas exhaustion from the open gas discharge 59 preferably is an angle of about 40 degrees outward with respect to the longitudinal axis of the cap, although the rearward angle may be between about 10 and about 50 degrees. This exhaust produces a jet thrust rearwardly out of the plenum and results in a forward force on the launch tube which further contributes to the reduction in recoil. Further, the exhaust apertures 29 are preferably progressively larger in size, smaller at the breech input end 22 and larger towards the brake exit 16 end. This progressive increase in aperture diameter serves to meter or distribute the exhaustion of the gases. This permits retention of the gases for use on as many of the series of dual reaction surfaces 38 and 56 as desired. Maximum use of the gas force enhances the total forward thrust created by the gases on these surfaces and thereby helps to eliminate all of the recoil on the gun. This metering and retention of gases in the brake should be such that the gases are substantially exhausted through the apertures 29 before the projectile completes its travel through the brake exit 16.

Knowing the velocity of a projectile, the set of conditions can be ascertained for a given weapon by firing the projectile and observing the timing and magnitude of pressure surges in each expansion stage. A simple, empirical way of sizing the expansion stages and their apertures lies in applying artist's white chalk to the gas exit portions of the expansion stages. To the extent hot gases contact the chalk it will change the color and appearance of the chalk. By adjusting the aperture sizes and the volumes of the individual expansion chambers or plenums until the chalk color changes are about the same, the overall volumes of gases will be distributed in a proper proportion within the stages.

In applying the invention to a particular weapon, it is possible to approach the design of a recoil brake system for the weapon in the following manner. One or two stages of reaction surfaces with unrestrained venting onto a flat reaction surface or a somewhat dished reaction surface may be installed on the barrel of the weapon and the gases vented transversely from within the barrel to impact the surface or surfaces. It has been found that the area of the reaction surface or surfaces may be increased until the amount of counter-recoil force obtained by impacting the venting gases on the one or two reaction surfaces reaches a limiting value equal to about 60 to 65 percent of the recoil. It has further been found that by increasing the number of stages in accordance with the invention, this same amount of reaction surface area can be made to be effective in accordance with the invention to counter substantially all of the recoil. Moreover, this total amount of area may actually be reduced substantially, for example, about 75 or 80 percent, by application of the principles of the invention.

As explained earlier, these principles include increasing the number of stages to reduce the reaction area per stage and to permit each stage to contribute a share of the total recoil reduction, installing internal and/or external reaction surfaces to fully exploit the forces available from the rapidly expanding propellant gases, directing the expanding gases to travel in specific forward and rearward directions, and in balancing the gases vented from the various stages. Further, increasing the number of stages to reduce the reaction area per stage frequently results in a more aesthetic or practical muzzle brake. For example, wide sections of external reaction area may present serious problems when sighting a target or in handling or balancing a weapon. Similarly, from an aesthetic standpoint, an aesthetically acceptable ratio of overall brake diameter to rifle barrel diameter is about 1 to 1. The muzzle brake having a plurality of plates in accordance with the invention in such a configuration also does not interfere with use of low sighting weapons. For example, a muzzle brake for a 30 calibrator rifle that is both effective at reducing substantially all of the recoil and aesthetically pleasing has 10 interior plates and the diameter of the brake is about 0.78 inches.

There are several methods of measuring recoil so that the effectiveness of the muzzle brake may be determined. One approach is to mount the weapon in a stand on an appropriate spring scale. The weapon is pointed vertically in the air and fired. A gauge connected to the scale records and reports the maximum rearward recoil thrust.

It is contemplated that the present invention reduces recoil significantly better than apparatus previously used, because the muzzle brake retains the explosive force of the propellant gases for a longer period. Previously known devices have generally attempted to exhaust the gas as quickly as possible, but thereby waste the forces available to reduce recoil. The gases in the muzzle brakes of the present invention are vented to the atmosphere through metered openings. These must be properly sized to retain gases in the muzzle brake so that each impingement surface receives a nearly equal portion of the gas force. Accordingly, it is a feature of this invention to compensate for substantially all of the recoil force, including the 26 percent or so of the recoil force on a gun created by the gases exiting the muzzle. To further reduce the recoil force arising from the jet thrust of gases erupting from the muzzle, it is important that the last circumferential set of apertures, i.e., the set closest to the brake exit 16 exhaust substantially all of the remaining expansive gases from the muzzle brake before the projectile exits the brake.

FIG. 9 illustrates an alternate embodiment preferably for a shotgun-type weapon that would use a tapered aperture 90 similar to that illustrated in FIG. 8, to attain significant reduction of recoil. This is accomplished by metering the distance between the exterior plates 103 which define both the expansion chambers 104 and the reaction surfaces 106 for the propellant gases. Using the distance between the first two plates as a base B, the distance $D_N$ between a subsequent plate N and its adjacent plate may be determined by computing $D_N = B \times (1 + (N-2)/Y)$, where N is a plate number greater than or equal to 3 for which the distance is being computed; B is the base distance between the first two plates; and Y is the number of plates in the muzzle brake.

The muzzle brakes of the present invention can be fabricated by machining, metal forming, investment casting and other methods of fabrication. The muzzle brakes can be made from various metals and alloys such as 7550 aluminum, plastics, ceramic metal compositions and composite materials containing glass, boron or graphite fibers for strength. RYNITE plastic, marketed by duPont, is contemplated to be suitable.

Assembly of the caps 53 on the tube 12 does not require that the exterior or interior surfaces be threaded. The caps for example can have a non-threaded bore 62 slightly greater in diameter than the exterior diameter of the tube 12. This permits the cap 53 to slip over the tube 12. Once properly positioned with respect to the apertures and interior plates, the caps 53 may be welded in place. Further, the tube 12 may be made in longitudinal halves without the interior thread 34. The inner plates in this instance can be positioned along the inner bore and the two portions of the tube 12 press fit together. Other alternate processes to manufacture and assemble muzzle brakes of the present invention may be readily thought of by those of ordinary skill in the art.

The principles, preferred embodiments and modes of operation of the present invention have been described in the foregoing specification. The invention is not to be construed as limited to the particular forms disclosed, since these are regarded as illustrative rather than restrictive. Moreover, variations and changes may be made by those skilled in the art without departing from the spirit of the invention as described by the following claims.

What I claim is:

1. A muzzle brake for reducing recoil of a projectile launch tube when a projectile is ejected from the muzzle of the launch tube by exploding gas, comprising:

a tube adapted at its rearward or breech end to attach to the muzzle of the launch tube;

a plurality of longitudinally spaced plates within the tube generally transverse to the longitudinal bore of the tube, each plate defining a bore arranged and sized to enable the projectile to pass through the plate;

a plurality of longitudinally spaced sets of circumferentially spaced apertures in the tube, a separate such set extending from the interior of the tube between each pair of adjacent plates to the exterior of the tube and at least one of the spaced sets of apertures directing gas from the tube at an angle different from that of the others of the spaced sets of apertures; and a separate gas plenum mounted on the exterior of the tube for each set of said apertures, each plenum configured to exhaust gas received from the tube rearward at an angle between about 10 and about 50 degrees relative to the longitudinal axis of the tube.

2. A muzzle brake as recited in claim 1, wherein the size of the apertures in any given circumferential set is less than the size of the apertures in the next adjacent circumferential set closer to the forward end of the tube.

3. A muzzle brake as recited in claim 1 wherein each set of apertures is forwardly angled between about 30 and about 60 degrees with respect to the longitudinal axis of the brake.

4. A muzzle brake as recited in claim 1 wherein each set of apertures other than the set nearest the muzzle end of the tube is positioned to direct gas into its respective plenum forwardly at an angle between about 30 degrees and about 60 degrees with respect to the longitudinal axis of the brake, and the set nearest the muzzle end of the tube is positioned to direct gas into its respective plenum at about 90 degrees with respect to the longitudinal axis of the tube.

5. A muzzle brake as recited in claim 4 wherein each plenum is configured to exhaust gas rearward at an angle between about 10 degrees and about 50 degrees outwardly with respect to the longitudinal axis of the bore.

6. A muzzle brake as recited in claim 1 wherein the apertures are tapered from an inlet to a smaller outlet to define a venturi for gases passing through the aperture.

7. A muzzle brake as recited in claim 6 wherein the size of the inlets in any given circumferential set is less than the size of the inlets of the apertures in the next adjacent circumferential set closer to the forward end of the tube; and wherein the size of the outlets in any given circumferential set is less than the size of the outlets in the next adjacent circumferential set closer to the forward end of the tube.

8. A muzzle brake as recited in claim 6 wherein the apertures are forwardly angled about 40 degrees with respect to the longitudinal axis of the brake.

9. A muzzle brake as recited in claim 4 which has at least ten plates.

10. A muzzle brake as recited in claim 1 wherein the bore of each interior plate is chamfered.

11. A muzzle brake as recited in claim 1 wherein each plate is dished in cross-section toward the forward end of the tube.

12. A muzzle brake as recited in claim 1 wherein the surface of each plate is roughened.

13. A muzzle brake for reducing recoil of a projectile barrel when a projectile is fired from the bore of the barrel, comprising:

a tube having a longitudinal bore greater in diameter than that of the barrel bore and adapted at a first or rearward end to mount to the gun muzzle and defining a bore exit at its second or muzzle end;

a plurality of longitudinally spaced and transversely disposed interior plates within the longitudinal bore of the tube, defining a separate internal expansion chamber between each pair of adjacent plates, each plate defining a bore aligned with the longitudinal axis of the tube and a diameter approximately equal to the barrel bore;

a plurality of radially spaced longitudinally extending continuous slots in the tube, each slot tapering wider towards the bore exit; and a separate gas plenum mounted on the exterior of the tube adjacent to each chamber, each plenum having an upstream end adapted to receive gas from its adjacent chamber and an open end facing toward the first end of the tube for exhaustion of gas.

14. A muzzle brake as recited in claim 13 wherein the open end of the plenum defines a skirt having an interior surface.

15. A muzzle brake as recited in claim 14 wherein the skirt angles between about 10 degrees and about 50 degrees outwardly with respect to the longitudinal axis of the bore.

16. A muzzle brake as recited in claim 13 wherein the open end of each plenum is larger than the upstream end.

17. A muzzle brake as recited in claim 13 wherein the bore of each interior plate is chamfered.

18. A muzzle brake as recited in claim 13 wherein the gas impingement surface of each plate is roughened.

19. A muzzle brake as recited in claim 13 wherein the interior plate in cross-section is dished towards the bore exit of the tube.

20. A muzzle brake for reducing recoil of a shotgun, comprising:

a tube having a longitudinal bore with a diameter about equal to that of the shotgun barrel adapted at a first end to mount to the muzzle of the shotgun, and defining a bore exit at its second end;

a plurality of circumferentially spaced, longitudinally extending continuous slots in the tube, each slot tapering wider towards the bore exit; and a plurality of longitudinally spaced exterior plates defining a separate external expansion plenum between each pair of adjacent plates, each plenum defining an open end for exhaustion of gas, and with the distance $D_N$ between any given exterior plate N and its adjacent exterior plate toward the second end of the tube being computed from the formula $D_N = B \times (1 + (N-2)/Y)$, where B is the distance between the first two plates nearest the first end, N is the plate number greater than or equal to 3 for which the distance is being computed, and Y is the number of plates in the muzzle brake.

21. A muzzle brake for reducing recoil of a projectile launch tube when a projectile is fired from the muzzle of the launch tube by exploding gas, comprising:

a tube having a breech or rearward end and a muzzle or forward end, and adapted at its breech end to attach to the muzzle of the launch tube, the tube having a plurality of sets of forwardly directed apertures therein;

a plurality of longitudinally spaced plates within the tube, each plate being disposed generally transverse to the bore of the tube to provide first reaction wall surfaces and having a centrally disposed hole large enough to enable a projectile to pass from the breech end through the tube and the muzzle end, a separate such plate being provided forwardly of different ones of the associates sets of forwardly directed apertures in the tube and forming first expansion chambers internal of the tube so that a portion of the exploding gas passing through the breech end of the tube in a forwardly direction impinges on the plates forming the first expansion chambers with the exploding gas from the first expansion chambers being thereafter at least partially exhausted from the first expansion chambers through the associated sets of apertures; and a plurality of gas plenums along the outer surface of the tube to establish a plurality of second expansion chambers external of the tube, each plenum being formed at least in part by second reaction wall surfaces disposed to receive the forwardly directed exploding gas passing through the associated sets of apertures such that the exploding gas so received impinges on the second reaction wall surfaces of the gas plenums, and each plenum also being configured to allow exhaust of the gas after such gas has been received into the plenum through the associated set of apertures.

22. A muzzle brake as recited in claim 21 in which each given plenum, positioned upstream from the plenum nearest to the muzzle end of the tube, and its associated set of apertures are configured such that a portion of exploding gas at the first expansion chamber associated therewith is forced to exhaust to the adjacent downstream first expansion chamber to thereby assure receipt of exploding gas at each of said first and second expansion chambers.

23. A muzzle brake as recited in claim 21 in which the forward direction lies at an angle between about 30 degrees and about 60 degrees relative to the bore of the tube.

24. A muzzle brake as recited in claim 23 in which each plenum is configured to exhaust gas rearwardly at an angle between about 10 and 50 degrees relative to the bore of the tube.

25. The muzzle brake of claim 24 in which the apertures for any given stage are smaller than the apertures for the stage forward of the given stage.

26. A muzzle brake as recited in claim 24 wherein each plate is chamfered to a sharp edge to define its centrally disposed hole.

27. A muzzle brake as recited in claim 25 wherein the surface of each plate facing the breech end of the tube is roughened.

28. A muzzle brake as recited in claim 25 wherein each plate in cross section is dished toward the muzzle end of the brake.

29. A muzzle brake for reducing recoil of a projectile launch tube when a projectile is fired from the muzzle of the launch tube by exploding gas, comprising:

a tube having a breech or rearward end and a muzzle or forward end, and adapted at its breech end to attach to the muzzle of the launch tube; and at least three different sized gas plenums attached side-by-side in a stage-by-stage row along the outer surface of the tube, with the tube having at least one passageway therein formed as a longitudinally disposed slot with each slot being continuous from stage to stage and increasing in breadth toward the muzzle end of the tube, each plenum thus having a different sized passageway leading from the tube for the reception of exploding gas, each plenum also being configured to exhaust the gas so received rearward of the tube, and each given plenum and its passageway defining a given separate gas expansion stage which is configured to force a portion of exploding gas in the tube to exhaust through each other expansion stage between the given expansion stage and the muzzle end of the brake.

30. A muzzle brake as recited in claim 29 in which the sizes of the plenums progressively increase from the breech end to the muzzle end of the brake.

31. A recoil brake for reducing the recoil of a projectile launch tube when a projectile is launched from the muzzle end of a launch tube by propellant gases, comprising:

an elongated brake tube having a rearward or breach end adapted to be attached to the muzzle end of the launch tube, and a forward or muzzle end;

a plurality of gas expansion stages arranged end-to-end along the length of the brake tube, each such stage including, (a) a gas plenum of different size for each gas expansion stage attached to the external surface of the brake tube, (b) a reaction surface within the plenum facing generally toward the rearward end of the brake tube, (c) a passageway of different size for each gas expansion stage to receive a stream of propellant gases from within the brake tube and to impinge the stream against the reaction surface, and (d) an exhaust port adapted to exhaust propellant gases, following their impingement on the reaction surface rearward of the expansion stage at an angle of about 10 and about 50 degrees relative to the length of the brake tube;

the gas expansion stages configured to have a composite flow capacity and a composite reaction area capable of receiving a sufficient portion of the propellant gases from the interior of the brake tube before the projectile exits the forward end to substantially reduce the volume of propellant gases released from the forward end, and to generate a composite counter-recoil equal to at least 80% of the recoil; and each give expansion stage configured relative to each other expansion stage to have a substantial proportion of the composite flow capacity and a substantial proportion of the composite reaction area to generate a substantial proportion of the counter-recoil.

32. A recoil brake as recited in claim 31 wherein each gas expansion stage further comprises a reaction surface within the brake tube facing the rearward end of the brake tube and defining a bore sized to permit passage of the projectile.

33. A muzzle brake for an automatic weapon including a barrel and a slide receiver with the muzzle brake being connected with the slide receiver at the muzzle end of the automatic weapon, including:

a plurality of longitudinally spaced plates within the slide receiver generally transverse to the longitudinal axis of the barrel, the plates and the slide receiver defining a plurality of expansion plenums;

a plurality of longitudinally spaced sets of circumferentially spaced interior passageways in the barrel, a separate such set associated with each plenum and extending from the interior of the barrel forwardly to its associated plenum; and a plurality of longitudinally spaced sets of circumferentially spaced passageways to exhaust gas received from the barrel rearwardly.

* * * * *